US007168159B2

(12) United States Patent
Imai

(10) Patent No.: US 7,168,159 B2
(45) Date of Patent: Jan. 30, 2007

(54) WIRE TERMINATION APPARATUS

(75) Inventor: Kouji Imai, Kawasaki (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 454 days.

(21) Appl. No.: 10/671,928

(22) Filed: Sep. 26, 2003

(65) Prior Publication Data

US 2004/0060339 A1 Apr. 1, 2004

(30) Foreign Application Priority Data

Sep. 26, 2002 (JP) ..... 2002-281159
Aug. 1, 2003 (JP) ..... 2003-284664

(51) Int. Cl.
*H01R 43/04* (2006.01)
*H01R 43/048* (2006.01)
*H01R 43/055* (2006.01)

(52) U.S. Cl. ..... 29/749; 29/281.4; 29/753; 29/755; 29/760; 29/862; 29/872

(58) Field of Classification Search ..... 29/753, 29/749, 755, 861–863, 872, 871, 33 M, 868, 29/281.4–281.6, 760; 72/409.14
See application file for complete search history.

(56) References Cited

U.S. PATENT DOCUMENTS 2,908,910 A * 10/1959 Andren ..... 29/33.5
3,587,158 A * 6/1971 Sullivan ..... 29/748
4,040,180 A * 8/1977 Brown ..... 29/753
4,272,879 A * 6/1981 Wigby et al. ..... 29/566.2
4,654,952 A * 4/1987 Baldyga ..... 29/566.2
4,667,397 A * 5/1987 Day et al. ..... 29/748
5,176,228 A * 1/1993 Baldyga ..... 188/67
5,564,613 A * 10/1996 Baldyga ..... 242/615.3
5,907,901 A * 6/1999 Hogan et al. ..... 29/753

(Continued)

FOREIGN PATENT DOCUMENTS

JP 61-133590 6/1986

(Continued)

OTHER PUBLICATIONS

Howstuffworks "Inline Four-Cyliner Engine," Apr. 13, 2000□□Online: http://web.archive.org/web/20030413091537/http://auto.howstuffworks.com/engine-inline.htm.*

*Primary Examiner*—Peter Vo
*Assistant Examiner*—Livius Radu Cazan
(74) *Attorney, Agent, or Firm*—Barley Snyder LLC

(57) ABSTRACT

In a wire termination apparatus, an anvil for placing a terminal thereon is mounted on a base plate, corresponding in position to a crimper of a ram. The terminal is crimped by a crimping portion, which includes the crimper and the anvil. An elongate link piece is mounted on the ram, and a guide member having a groove in which an elongate component, such as a fluorescent tube, is placed, is mounted on the tip of the link piece. The guide member is positioned to be aligned with the terminal placed on the anvil, when the ram is in its uppermost position. A conductive lead of the component and a conductor of an insulated wire are inserted into the terminal from directions perpendicular to each other, then the terminal is crimped by the crimper.

7 Claims, 5 Drawing Sheets

U.S. PATENT DOCUMENTS 6,742,251 B1 * 6/2004 Fukase ..... 29/863
6,881,104 B2 * 4/2005 Suzuki et al. ..... 439/877

FOREIGN PATENT DOCUMENTS

JP 04-112490 9/1992
JP 04112490 U * 9/1992
JP 08-105819 4/1996
JP 9-82449 3/1997
JP 09-161938 6/1997
JP 09161938 A * 6/1997
JP 10261476 A * 9/1998
JP 2003272725 9/2003

* cited by examiner

FIG.6
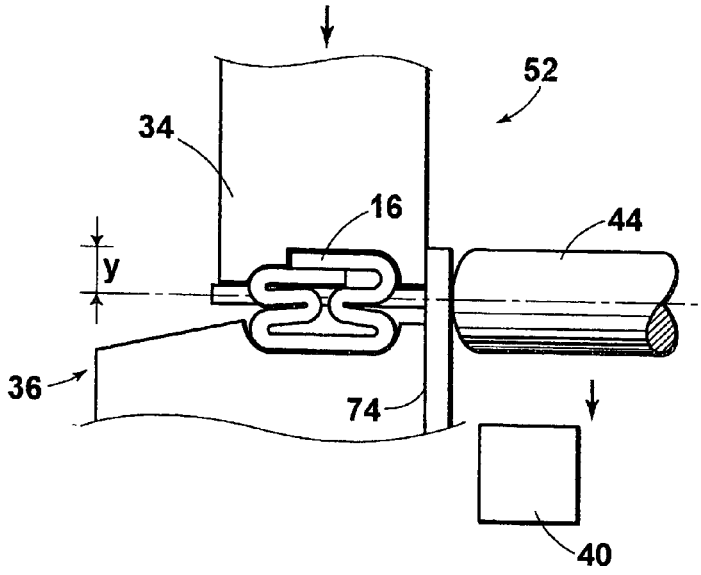
FIG.7
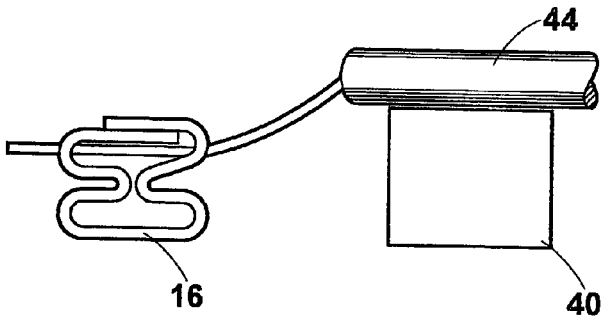
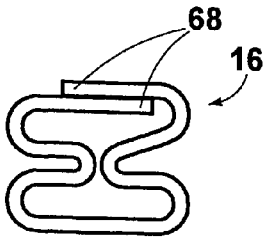
FIG.8A
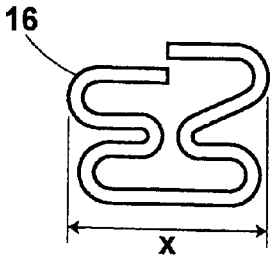
FIG.8B
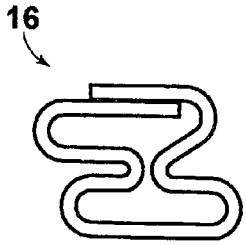
FIG.8C

WIRE TERMINATION APPARATUS

FIELD OF THE INVENTION

The present invention relates to a termination apparatus for connecting a terminal to a conductor, and more particularly to a conductive lead of a component.

BACKGROUND OF THE INVENTION

In electronic assemblies, it is often advantageous to provide a mechanical and electrical connection at the end of a conductor, such as a wire or component lead. This connection is referred to as a termination, and may be formed, for example, using a terminal to receive and connect to the conductor.

An existing wire termination apparatus for connecting wires to terminals is described in Japanese Unexamined Patent Publication No. 61(1986)-133590. This wire termination apparatus comprises a guide member for guiding a lead wire within a cylindrical metallic ring of a round terminal (see e.g., pages 3–4, FIG. 5, FIG. 6). The guide member is of a conical shape, comprising two vertically split conical halves.

Another known wire termination apparatus is described in Japanese Unexamined Patent Publication No. 9(1997)-82449. This wire termination apparatus comprises two positioning guides disposed in the horizontal direction for guiding a conductive portion of a wire into a wire insertion aperture of a closed barrel terminal (see e.g., pages 3–4, FIG. 1). The positioning guides are structured to be divisible into two parts horizontally.

In the wire termination apparatus disclosed in Japanese Unexamined Patent Publication No. 61(1986)-133590, the guide member is a closed annulus, and is not open in an upward direction. During insertion, it is necessary to aim a conductor into the annular portion of the guide member. Accordingly, the wire insertion operation is difficult. In addition, a possibility exists that the wire will abut the conical guide member and bend.

In the wire termination apparatus disclosed in Japanese Unexamined Patent Publication No. 9(1997)-82449 as well, the guides are not open in an upward direction. Therefore, the conductor insertion operation is again difficult. In addition, a possibility exists that the conductor portion will abut the conical guide member and bend.

In both of the existing wire termination apparatuses described above, conductors are inserted into terminals by wire conveyance mechanisms or while being gripped by a clamp. However, when the conductor is a conductive lead that only slightly protrudes from the end of an elongate component, such as a fluorescent tube, the above methods cannot be employed without a high risk of damage to the component. Displacement of the conductor during termination induces stress at the junction of the conductor being forced downward by the crimping action and the body of the component being held in place. This stress can cause damage to the component.

SUMMARY OF THE INVENTION

The present invention has been developed in view of the forgoing considerations. It is an object of the present invention to provide a wire termination apparatus that facilitates positioning of a conductive lead of an elongate component with respect to a terminal, thereby facilitating a termination operation.

It is another object of the present invention to provide a wire termination apparatus in which damage to a component, due to a load applied to the conductor or lead of that component during termination, is prevented.

It is still another object of the present invention to provide a wire termination apparatus in which a drive mechanism for a guide member is simplified.

It is yet another object of the present invention to provide a wire termination apparatus in which interference between a crimper and an elongate component during termination is capable of being prevented.

The termination apparatus of the present invention comprises an anvil configured to support a collapsible terminal and a crimper aligned with the anvil. The crimper and the anvil are movable toward and away from each other to crush and release the terminal. A guide member having an upwardly open guide groove is provided close to the anvil and aligned therewith for supporting a component and guiding the conductive lead of the component into an insertion hole in the terminal.

The guide member may be configured to be driven to retreat from the elongate component corresponding to the downward motion of the crimper, before the crimper abuts the terminal.

The guide member may be linked to the crimper to drive the guide member downward when the crimper moves downward with respect to the anvil. The guide member may be linked with the crimper via a link piece.

The anvil may further comprise a positioning plate for positioning the elongate component by abutting the tip thereof, the positioning plate having an escape groove for allowing movement of the core wire during termination thereof.

The termination apparatus of the present invention comprises the guide member having the upwardly open groove, provided close to the anvil and aligned therewith, structured so that when the elongate component having the conductive lead at the tip thereof is received in the guide groove, the conductive lead is aligned with respect to an insertion hole in the collapsible terminal. Therefore, the following effects are exhibited.

The conductive lead is positioned with respect to the insertion hole simply by placing the elongate component, such as a fluorescent tube, in the guide groove of the guide member. The conductive lead is enabled to be inserted into the terminal by moving the elongate component along the guide groove. Therefore, the conductive lead insertion operation is facilitated.

In the case that the guide member is driven to retreat from the elongate component before the crimper abuts the terminal, damage to the main body of the elongate component, due to a load applied to the conductive lead during termination, is prevented.

Further, in the case that the guide member is linked with the crimper, the drive mechanism for the guide member is simplified.

Still further, in the case that the anvil is equipped with a positioning plate for positioning the elongate component by abutting the tip thereof, the positioning plate having an escape groove for allowing movement of the core wire during termination thereof, positioning of the elongate component is facilitated by the positioning plate. In addition, interference between the crimper and the elongate component is precluded. Therefore, damage to the elongate component is prevented.

BRIEF DESCRIPTION OF THE DRAWINGS

The invention will be described with reference to the accompanying drawings, of which:

FIG. 6 is a side view of the crimping portion of the termination apparatus of FIG. 1, in a state in which the terminal is crimped;

FIG. 7 is a side view of the termination apparatus of FIG. 1, showing the positional relationship between the crimped terminal and a fluorescent tube; and FIG. 8A, FIG. 8B, and FIG. 8C show side views of various shapes of crimped terminals.

DETAILED DESCRIPTION OF THE INVENTION

An exemplary embodiment of the wire termination apparatus (hereinafter, simply referred to as "apparatus") according to the present invention will be described with reference to the attached drawings.

Figure 1:
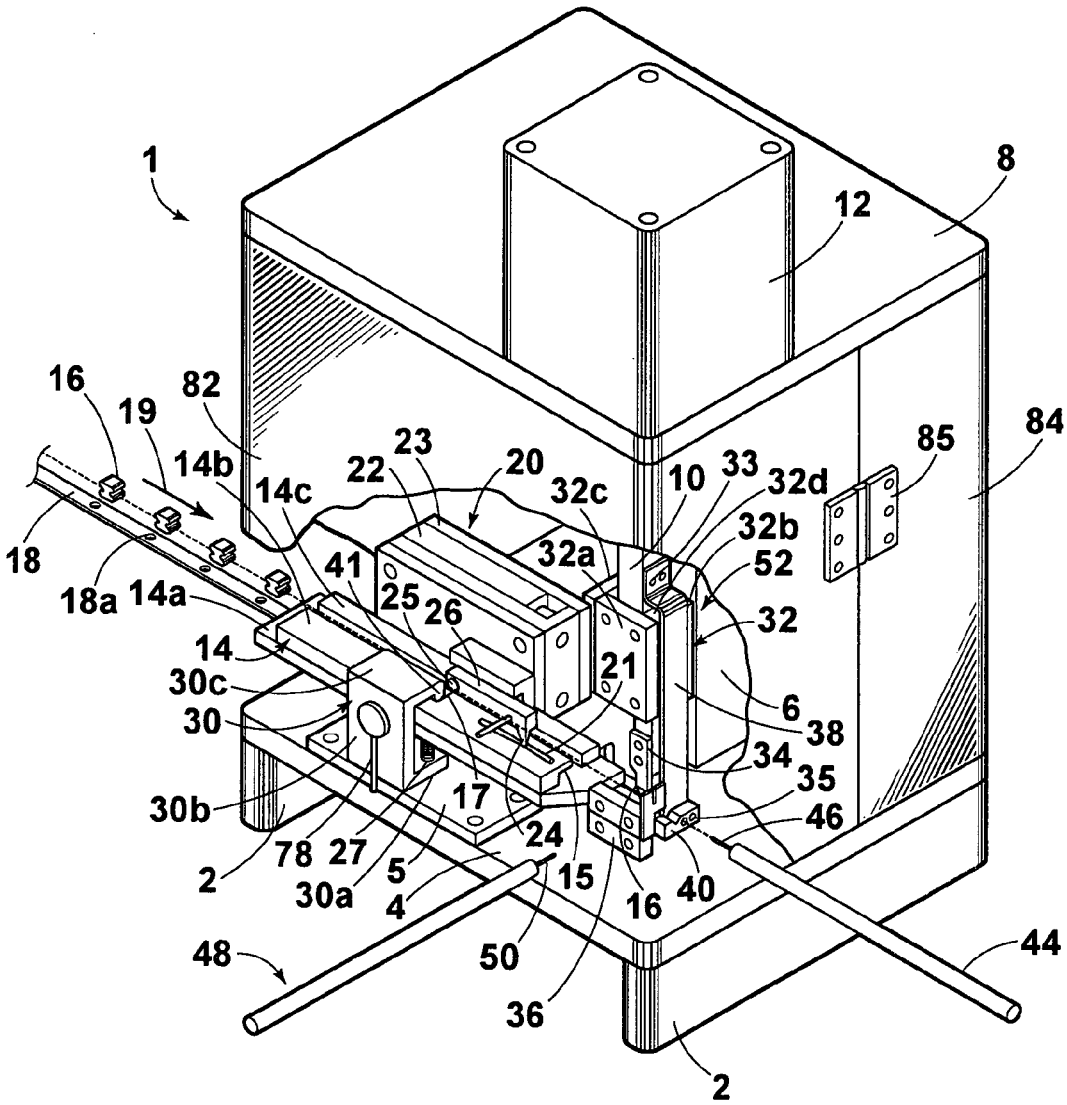
FIG. 1 is a perspective view, partially in section, showing a wire termination apparatus according to an exemplary embodiment of the present invention.

As shown in FIG. 1, the apparatus 1 comprises: a pair of legs 2; a base plate 4 supported by the legs 2; a frame 6 erected on the base plate 4; and a top plate 8 mounted on the upper portion of the frame 6. A box 84, which extends from the base plate 4 to the top plate 8, is mounted on the base plate 4. A vertically slidable ram 10 is mounted on the frame 6. The ram 10 is driven by an air cylinder 12, which is mounted on the top plate 8.

A rail or guide base 14, for guiding a carrier strip 18, is mounted on the rectangular base plate 4. A plurality of terminals 16 are integrally linked and held on the carrier strip 18 at predetermined intervals prior to crimping. A cover 82 for covering the guide base 14 is mounted on the box 84 via a hinge 85, so that it can be opened and closed.

A planar mounting plate 5 is fixed to the base plate 4 by bolts. The guide base 14 and a conveyance portion 20 for conveying the carrier strip 18 are fixed to the mounting plate 5 by bolts. The conveyance portion 20 is provided to the right (the direction indicated by arrow 19) of the guide base 14. A carrier brake 30 is supported by the guide base 14 so that it is movable perpendicularly with respect to the mounting plate 5. The carrier brake is provided more toward the surface of the drawing sheet than the guide base 14. Next, the guide base 14, the conveyance portion 20, and the carrier brake 30 will be described.

The guide base 14 comprises a wide planar main body 14*a* that extends in the conveyance direction of the carrier strip 18, and elongate guide plates 14*b* and 14*c* which are provided on the main body 14*a*, separated from each other. A downward facing step 15 for the carrier strip 18 to pass under is provided on the lower surface of the guide plate 14*b*, extending in the longitudinal direction of the carrier strip. A cut out 17 for housing the carrier brake 30 is formed in the guide plate 14*b*, at the central portion in the longitudinal direction thereof. The cut out 17 communicates through the downward facing step 15. The carrier strip 18 moves in the direction indicated by arrow 19 while being guided between the guide plates 14*b* and 14*c*. A slot 21 that communicates through the downward facing step 15 is formed in the guide plate 14*b*, along the longitudinal direction thereof. The slot 21 is formed on the downstream side of the guide plate 14*b* (in the vicinity of the right side thereof when viewing FIG. 1).

The conveyance portion 20, which is fixed to the mounting board 5 adjacent to the guide base 14, is constructed of a substantially box shaped block 23. An air cylinder 22 is provided within the block 23. A pin 25 is mounted on a reciprocating drive shaft (not shown) of the air cylinder 22, so that the pin 25 is perpendicular to the drive shaft. The pin 25 protrudes from the side of the block 23, and is linked to an arm 26 provided on the guide base 14. A slot (not shown) for receiving the pin 25 is formed in the block 23. By this construction, the pin 25 is enabled to reciprocate along the carrier strip 18, accompanying the drive shaft of the air cylinder 22. A downward facing claw 24 is provided at the other end of the arm 26. The claw 24 engages pilot holes 18*a* of the carrier strip 18 by entering the slot 21. The carrier strip 18 is moved by the movement of the claw 24.

Next, the carrier brake 30 in the vicinity of the guide base 14 will be described. The carrier brake 30 is a substantially C-shaped member, and comprises: a plate-shaped base portion 30*a*, which is provided on the mounting plate 5; a plate-shaped actuating portion 30*c* for actuating the brake; and a link portion 30*b* that links the base portion 30*a* and the actuating portion 30*c*. A compression coil spring 27 is provided between the base portion 30*a* and the main body 14*a* of the guide base 14. The coil spring 27 normally presses the carrier brake 30 downward, toward the mounting plate 5.

A ridge 41, which enters the cut out 17 toward the carrier strip 18, is formed at the tip of the actuating portion 30*c*. Accordingly, the ridge 41 elastically presses the carrier strip 18 from above by the force of the coil spring 27, to restrict movement of the carrier strip 18, in a normal state. However, when the carrier strip 18 is conveyed by the arm 26 of the conveyance portion 20, the conveyance force overcomes the frictional engagement between the carrier strip 18 and the carrier brake 30, to convey the carrier strip 18 in the longitudinal direction thereof.

A handle 78 is rotatably mounted on the link portion 30*b* of the carrier brake 30. A cam (not shown) which is linked to the handle 78 is interposed between the guide base 14 and the carrier brake 30. The carrier brake 30 is constructed to move vertically according to rotation of the handle 78. In this manner, engagement and release of the carrier brake 30 with respect to the carrier strip 18 as desired, is enabled. When the carrier strip 18 is to be removed, the handle 78 is rotated to disengage the carrier brake 30 from the carrier strip 18, then the carrier strip 18 is removed.

Next, the movement of the ram 10 will be described. A ram case 32 is mounted on the frame 6. The ram 10 is guided in the vertical direction by the ram case 32. That is, the ram 10 is guided by the plates 32*a*, 32*b*, 32*c*, and 32*d*, which form the ram case 32. A crimper 34, for crushing terminals 16, is mounted on the lower end portion of the ram 10. An anvil 36, on which the terminals 16 are placed, is mounted on the base plate 4, corresponding in position to the crimper 34. The terminals 16 are crushed by a crimping portion 52, which comprises the ram 10, the crimper 34, and the anvil 36. The manner in which the terminals 16 are crimped will be described later. Note that here, "crimping" refers to the crushing of the terminals 16.

An elongate link piece 38, which extends along the sliding direction of the ram 10, that is, the vertical direction, is mounted to the ram 10 by screws 33. A guide member 40 is mounted on the tip of the link piece 38 by screws 35.

The guide member 40 is positioned such that it becomes aligned with a terminal 16 placed on the anvil 36 when the ram 10 is positioned at its uppermost position. A conductive lead 46, which is a comparatively rigid single core wire extending from an elongate component such as a fluorescent lamp or a fluorescent tube 44, and a core wire 50 of an insulated wire 48 are inserted into the terminal 16 from directions perpendicular to each other. The terminal 16 is then crimped by the crimper 34. The core wire 50 may be a single wire, or a twisted wire comprising a plurality of wires.

Next, the terminal 16 suitable to be operated on by the wire termination apparatus of the present invention will be described with reference to FIG. 2. A detailed description of the terminal 16 is given in "Wire Connector" (Japanese Patent Application No. 2002-280742, filed on Sept. 26, 2002). Here, only a general description of the terminal 16 will be given.

Figure 2A:
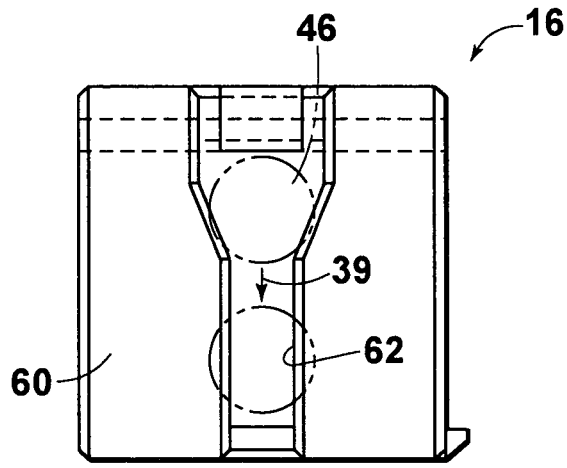
FIG. 2A is a side view of a terminal which is used by the wire termination apparatus of FIG. 1.
Figure 2B:
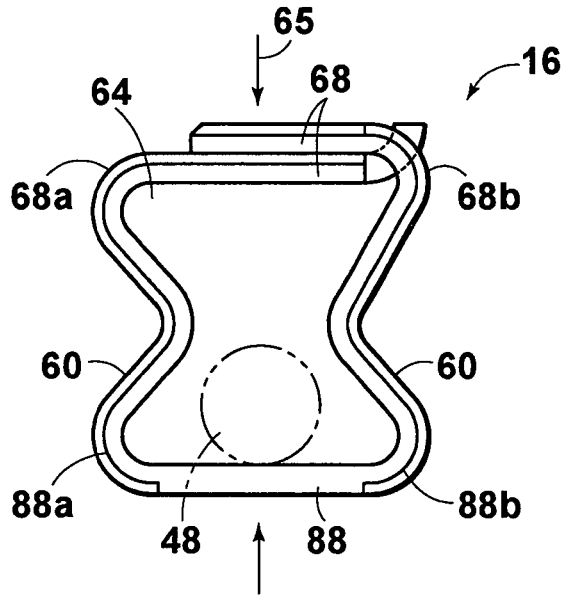
FIG. 2B is a front view of the terminal shown in FIG. 2A.

As shown in FIG. 2A and FIG. 2B, the terminal 16 is formed by punching out and bending a single metal plate so that it overlaps at its upper portion. The central portions of both side walls 60 are depressed toward the interior so that they approach each other. Vertically extending slots 62 (i.e., the conductive lead insertion holes) are formed in both side walls 60 at the central portions in the width directions thereof, that is, in the horizontal direction in FIG. 2A. The conductive lead 46 is placed within the slot 62, and the core wire 50 is placed within an open end 64 (i.e., the core wire insertion hole) of the terminal 16. Thereafter, the terminal 16 is crimped in the direction indicated by arrow 65 (FIG. 2B) to electrically connect and mechanically attach the conductive lead 46 and the core wire 50. At this time, the conductive lead 46 is pressed downward by an upper wall 69 of the terminal 16, to intimately contact the edges of the slot 62, as indicated by the arrow 39 of FIG. 2A.

Figure 3:
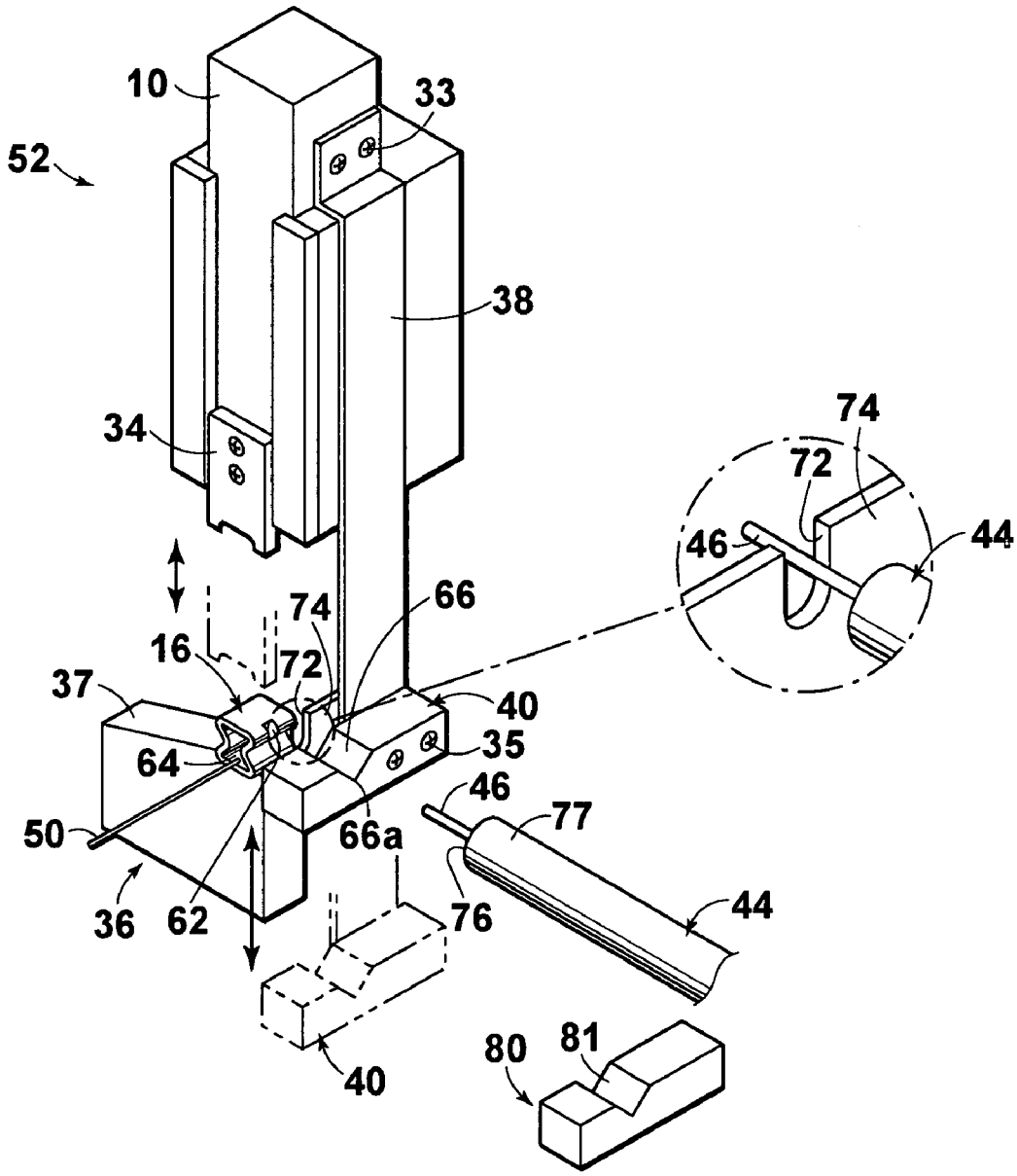
FIG. 3 is a detailed perspective view of a crimping portion of the wire termination apparatus of FIG. 1.
Figure 4A:
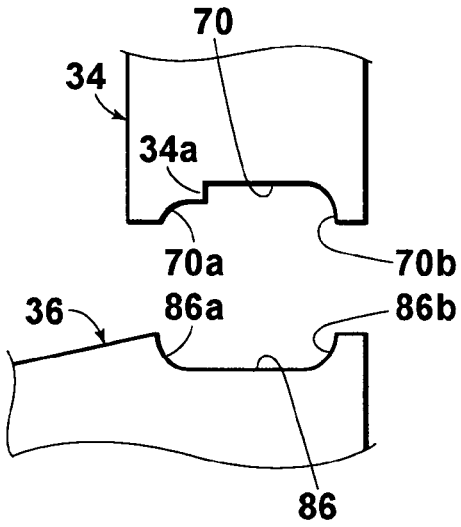
FIG. 4A shows a crimper and an anvil of the termination apparatus of FIG. 1, in a state in which the terminal is not placed on the anvil.
Figure 4B:
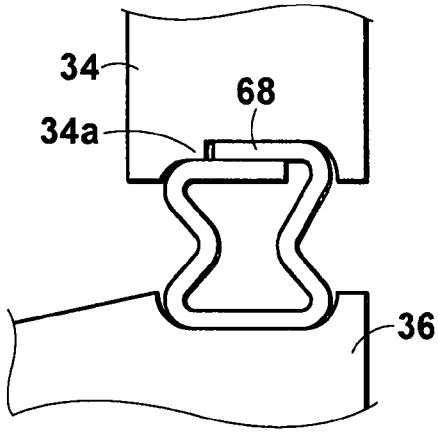
FIG. 4B shows a crimper and an anvil of the termination apparatus of FIG. 1, in a state in which the terminal is placed on the anvil, immediately prior to being pressed by the crimper.
Figure 5:
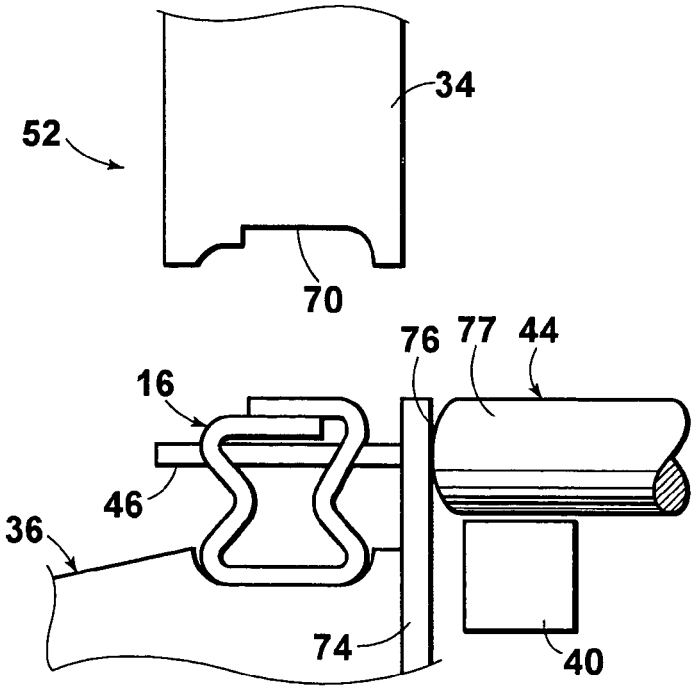
FIG. 5 is a side view of the crimping portion of the termination apparatus of FIG. 1, showing a state prior to crimping of the terminal.

Next, the crimping portion 52 will be described with reference to FIG. 3 through FIG. 6. FIG. 3 is a detailed perspective view of the crimping portion 52. FIG. 4A and FIG. 4B show the shapes of the anvil 36 and the crimper 34. FIG. 5 is a side view of the crimping portion 52 showing a state prior to crimping of the terminal 16. FIG. 6 is a side view of the crimping portion 52 in a state in which the terminal 16 is crimped. FIG. 7 is a side view showing the positional relationship between the crimped terminal 16 and the fluorescent tube 44. FIG. 8A, FIG. 8B, and FIG. 8C show side views of various shapes of crimped terminals 16.

In FIG. 3, the terminal 16 is placed on the anvil 36 in a pre-crimping position. Note that an inclined surface 37 of the anvil 36 is formed to prevent interference between the terminal 16 and the anvil 36, during conveyance of the terminal 16. When the ram 10 is at its uppermost position as shown in FIG. 3, the guide member 40 is aligned with the terminal 16, as described previously. The manner of this alignment is described hereunder.

An upwardly facing, that is, an upwardly open V-shaped groove 66 (guide groove) is formed in the guide member 40. The guide member 40 has a thickness of 8 mm in the direction along the V-shaped groove 66, and a height of 6 mm in the direction along the direction of movement of the ram 10. The most depressed central portion of the V-shaped groove, that is, a linear portion 66*a*, is aligned with the slot 62 of the terminal when viewed from above.

Meanwhile, the conductive lead 46 protrudes just 2 mm from a tip portion 77 of the fluorescent tube 44, which has a diameter of approximately 1.5 mm. The V-shaped groove 66 is formed at an angle and of a size such that the conductive lead 46 is positioned at the upper portion of the slot 62 of the terminal 16, when the tip position 77 of the fluorescent tube 44 is placed within the V-shaped groove 66. If the fluorescent tube 44 is pressed toward the terminal 16 along the V-shaped groove 66 in this state, the conductive lead 46 can be easily pressed into the slot 62. When the fluorescent tube 44 is to be placed within the V-shaped groove 66, the tip portion 77 needs only to be placed within the V-shaped groove from above. Therefore, the placement operation is extremely easy.

The core wire 50 is inserted into the lower side of the open end 64 of the terminal 16, beneath the conductive lead 46. When the tip portion 77 of the fluorescent tube 44 is placed in the V-shaped groove 66, the opposite end of the fluorescent tube is placed on a separate, fixed mounting base 80, which is similar to the guide member 40. The mounting base 80 is also provided with a V-shaped groove 81. The guide member 40 descends when the crimper 34 crimps the terminal 16, as indicated by the dotted line in FIG. 3. The guide member 40 descends before the crimper 34 contacts the terminal 16.

A positioning plate 74, which has an escape groove 72 in the form of a U-shaped slot, is provided between the terminal 16 and the guide member 40. The escape groove 72 is upwardly open, and is of a depth which allows vertical movement of the conductive lead 46 during crimping. Note that in order to clearly show the shape of the terminal 16, the escape groove 72 is only partially shown in the positioning plate 74 built into the crimping portion 52. The escape groove 72 is shown in detail in the circled portion of FIG. 3. The positioning plate 74 functions as a stopper for the fluorescent tube 44. That is, by abutting a tip 76 of the fluorescent tube 44 against the positioning plate 74 when the fluorescent tube 44 is placed on the guide member 40, the amount of insertion of the conductive lead 46 within the terminal 16 can be kept constant. In addition, interference between the crimper 34 and the fluorescent tube 44 is prevented, as the fluorescent tube 44 is prevented from entering the movement path of the crimper 34. In other words, insertion of the conductive lead 46 to a degree more than necessary, or to an insufficient degree, is prevented. At the same time, damage of the fluorescent tube 44 by the crimper 34 is also prevented.

Next, the shapes of the crimper 34 and the anvil 36 will be described with reference to FIG. 4A and FIG. 4B. FIG. 4A shows the crimper 34 and the anvil 36 in a state in which the terminal 16 is not placed on the anvil 36. FIG. 4B shows a state in which the terminal 16 is placed on the anvil 36, immediately prior to being pressed by the crimper 34. The portion of the crimper 34 that presses the terminal 16 is formed as a recess 70, of a shape complementary to the upper wall 68 of the terminal 16. That is, the crimper 34 has a step portion 34*a* corresponding to the plate thickness of the upper wall 68 of the terminal 16. In addition, arcuate surfaces 70*a* and 70*b*, for receiving the arcuate shoulders 68*a* and 69*b* (FIG. 2B) of the upper wall 68 of the terminal 16, are formed in the recess 70 of the crimper 34. A recess 86 for placing the terminal 16 therein is formed in the anvil 36. Arcuate surfaces 86*a* and 86*b*, for receiving arcuate portions 88*a* and 88*b* (FIG. 2B) at both sides of a lower wall 88 of the terminal 16, are formed in the recess 86. The reason why the recesses are formed is to prevent movement of the terminal 16 during crimping. Particularly, movement of the upper wall 68 is prevented by the step portion 34*a* so as to enable crimping while accurately maintaining the shape of the terminal 16. By this construction, crimping failure, such as spreading or deformation of the terminal 16, as shown in FIGS. 8A–8C, can be prevented. The states shown in FIGS. 8A–8C will be described later.

Next, the states of the terminal 16 and the guide member 40 during crimping will be described with reference to FIG. 5. In the state shown in FIG. 5, wherein the conductive lead 46 is inserted into the terminal 16 and preparations are complete for crimping, the fluorescent tube 44 is placed on the guide member 40. It is clearly shown that the tip 76 of the fluorescent tube 44 is abutting the positioning plate 74, which is outside the movement path of the crimper 34. The crimper 34 is lowered from this state, to perform crimping of the terminal 16. The crimped state of the terminal 16 is shown in FIG. 6.

As shown in FIG. 6, when the crimper 34 descends to crimp the terminal 16, the conductive lead 46 also moves downward slightly, for a distance y. The conductive lead 46 is enabled to move for the distance y within the escape groove 72. Therefore, the conductive lead 46 does not interfere with the positioning plate 74. In addition, the guide member 40, which is linked to the ram 10 via the link piece 38, moves downward along with the downward motion of the ram 10. Therefore, even if a downward force is exerted on the fluorescent tube 44 by the downward motion of the conductive lead 46 during crimping, the guide member 40 does not prevent downward movement of the fluorescent tube 44.

In the case that the guide member 40 does not move, a problem may be caused. The nature of the problem is shown in FIG. 7. In the case that the guide member 40 does not move, the position of the fluorescent tube 44 which is placed on the guide member 40 remains the same, while the conductive lead 46 is pulled by crimping, as shown in FIG. 7. Therefore, the load applied to the conductive lead 46 is transferred to the fluorescent tube 44, causing an excessive force to be exerted thereon. This causes a possibility that the fluorescent tube 44 will be damaged.

Next, various shapes of the crimped terminal 16 will be described with reference to FIG. 8A, FIG. 8B, and FIG. 8C. FIG. 8A shows a terminal 16 which has been correctly crimped. FIG. 8B and FIG. 8C each show terminals in which crimping failure has occurred. In the case that the terminal 18 has been correctly crimped, the upper wall 68 remains overlapped, while the terminal 16 is crushed in the vertical direction without being inclined toward either the right or left side in FIG. 8A. However, if the arcuate surfaces 70*a* and 70*b* (FIG. 4A) are not provided in the crimper 34, the upper wall 68 shifts in position, and the width dimension x of the terminal 16 is enlarged, as shown in FIG. 8B. In addition, if the recesses 70 and 86 of the crimper 34 and the anvil 36 are not aligned, the shape of the terminal 16 is deformed during crimping.

An exemplary embodiment of the present invention has been described in detail above. However, the present invention is not limited to the embodiment described above. To the contrary, the scope of the present invention is given by the appended claims together with their full range of equivalents. Many other embodiments are possible within the scope of these claims. For example, as a structure for causing the guide member 40 to move downward, an independent air cylinder that drives the guide member 40 may be provided instead of the structure described in the embodiment above. Alternatively, the guide member 40 may be supported from below by a spring, and caused to descend against the force of the spring when pressed by the ram 10 during the downward motion thereof. As a further alternative, the guide member 40 may be caused to rotate away from the fluorescent tube 44 as a linked operation with the downward movement of the ram 10.

The core wire to be inserted into the slot 62 is not limited to the conductive lead 46, and may be another, comparatively flexible core wire.

In the embodiment described above, the crimper 34 moves toward the anvil 36. However, a structure may be adopted wherein the anvil 36 moves toward the crimper 34 to perform crimping of the terminal 16.

I claim:

1. A wire termination apparatus for crimping a conductive lead of a component in a collapsible terminal having an insertion hole for receiving the conductive lead, the lead extending from a tip of the component, the apparatus comprising:

an anvil configured to support the collapsible terminal;

a crimper aligned with the anvil, and being movable toward and away from the anvil to crush and release the terminal;

a guide member having an upwardly open guide groove provided close to the anvil and aligned therewith for supporting the component and guiding the conductive lead into the insertion hole of the terminal; and a positioning plate for positioning the component to prevent interference between the crimper and the component by abutting the tip to the positioning plate, the positioning plate having an escape groove for allowing movement of the conductive lead during termination thereof;

wherein the guide member is directly connected via a link piece to a ram on which the crimper is mounted such that the guide member is caused to retreat from the component upon the downward motion of the crimper, before the crimper abuts the terminal.

2. A wire termination apparatus as defined in claim 1 wherein a terminal having a conductive lead inserted in the insertion hole and being placed on the anvil is crushed by the crimper, thereby terminating the conductive lead, which is inserted within the insertion hole of the terminal.

3. A wire termination apparatus as defined in claim 1 configured to allow insertion of a second conductor into the collapsible terminal disposed on the anvil in a direction perpendicular to the conductive lead.

4. A wire termination apparatus as defined in claim 1, further comprising:

a rail for guiding successive collapsible terminals mounted on a carrier strip onto the anvil.

5. A wire termination apparatus as defined in claim 4 wherein a carrier brake is mounted on the rail and biased into frictional contact with the carrier strip.

6. A termination apparatus for terminating a conductive lead of a component in a collapsible terminal having an insertion hole for receiving the conductive lead, the conductive lead extending from a tip of the component, the apparatus comprising:

an anvil;

a crimper movable toward and away from the anvil; and a guide member having an upwardly open guide groove for supporting the component in a sliding relationship such that the conductive lead is inserted into the insertion hole in the terminal; and a positioning plate for positioning the component to prevent interference between the crimper and the component by abutting the tip to the positioning plate, the positioning plate having an escape groove for allowing movement of the conductive lead during termination thereof;

wherein the guide member is directly connected via a link piece to a ram on which the crimper is mounted such that the guide member is caused to retreat from the component upon the downward motion of the crimper, before the crimper abuts the terminal.

7. A termination apparatus as defined in claim 6, wherein a recess is disposed in the anvil to retain the collapsible terminal and the crimper is disposed on a vertical ram, aligned with the recess.

* * * * *